United States Patent [19]

Yanai et al.

[11] Patent Number: 4,920,642

[45] Date of Patent: May 1, 1990

[54] METHOD FOR CONNECTING WIRES TO AN ELECTRICAL CONNECTOR

[75] Inventors: Masami Yanai; Hiroki Maeda, both of Kanagawa, Japan

[73] Assignee: Elco Corporation, Laguna Hills, Calif.

[21] Appl. No.: 94,180

[22] Filed: Sep. 4, 1987

[30] Foreign Application Priority Data

Sep. 24, 1986 [JP] Japan ..... 61-223725

[51] Int. Cl.[5] ..... H01R 43/02

[52] U.S. Cl. ..... 29/860; 29/882; 439/874

[58] Field of Search ..... 29/857, 860, 863, 874, 29/882; 439/874, 876, 880, 886; 174/84 C, 94 R, 88 R, 75 R

[56] References Cited

U.S. PATENT DOCUMENTS

| | | | |
|---|---|---|---|
| 2,648,827 | 1/1952 | Knollman | 439/874 |
| 3,020,520 | 2/1962 | Berg | 439/874 |
| 3,519,982 | 7/1970 | White, Jr. | 439/875 |
| 4,272,879 | 6/1981 | Wigby et al. | 29/884 X |
| 4,482,782 | 11/1984 | Sheppard | 174/84 C |
| 4,521,961 | 6/1985 | Roeschlein | 29/884 |

FOREIGN PATENT DOCUMENTS

| | | | |
|---|---|---|---|
| 198171 | 6/1958 | Austria | 174/84.1 |

OTHER PUBLICATIONS

AMP Advertisement, Electronics, p. 172, 9/1972.

*Primary Examiner*—P. W. Echols
*Attorney, Agent, or Firm*—David A. Greenlee

[57] ABSTRACT

A method for connecting the wires of a high density, flat transmission cable to a connector is provided. A crimp connector for facilitating the practice of the method is also provided. The connector includes one or more rows of contacts mounted thereto. Each contact includes a crimp section extending from the connector housing. The crimp sections are plated with a relatively thick layer of solder. After stripping the end of the cable, selected cable conductors are inserted within the crimp sections. A batch crimping operation secures the conductors to the contacts, after which the crimp sections are heated to fuse the solder. Once the solder has cooled, a reliable connection will be established between the cable and connector. A solder-plated bus bar may also be secured to selected cable conductors by preliminarily mounting the conductors thereto and then heating the bus bar.

11 Claims, 3 Drawing Sheets

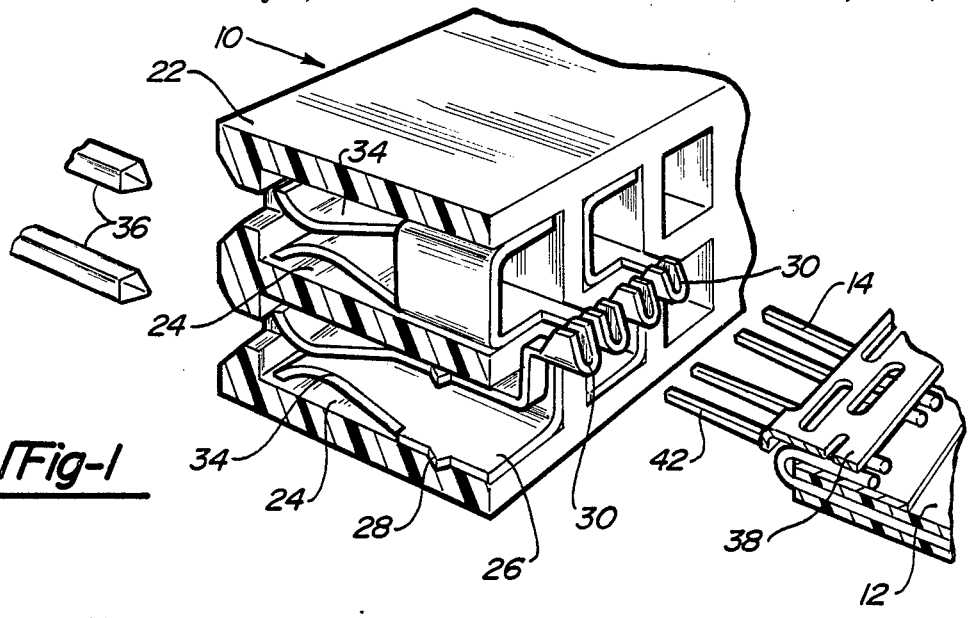
Fig-1
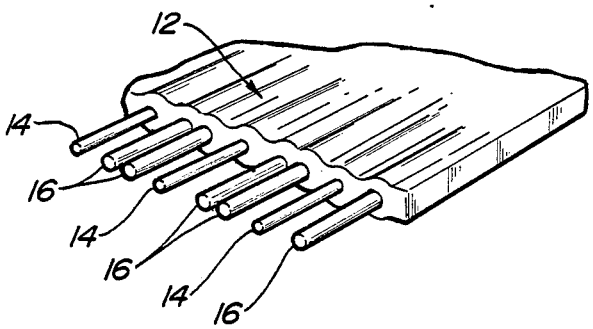
Fig-2
| | | | | | | | | | | | | |
|---|---|---|---|---|---|---|---|---|---|---|---|---|
| 1 | 3 | 5 | 7 | 9 | 11 | 13 | 15 | 17 | 19 | 21 | 23 | 25 |
| 2 | 4 | 6 | 8 | 10 | 12 | 14 | 16 | 18 | 20 | 22 | 24 | 26 |
Fig-3
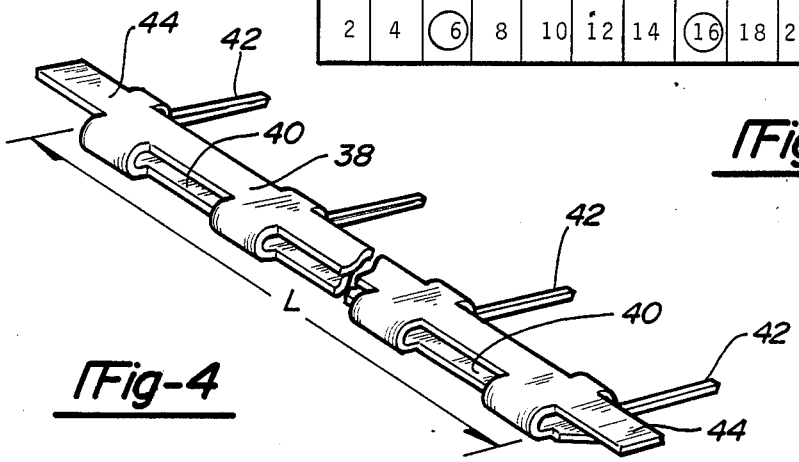
Fig-4

Fig-5
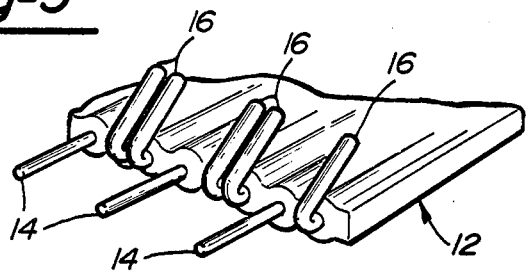
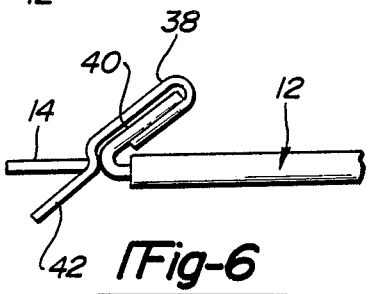
Fig-6
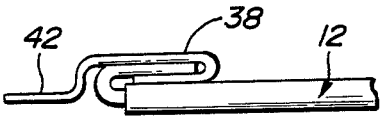
Fig-7
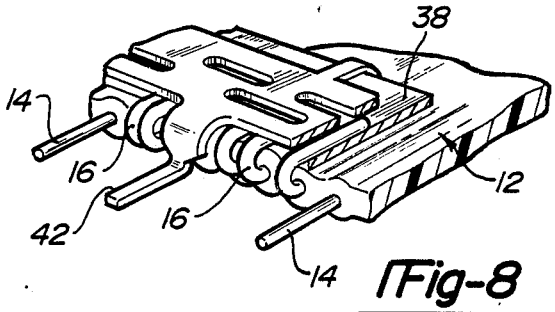
Fig-8
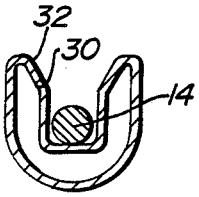
Fig-9b
Fig-9a
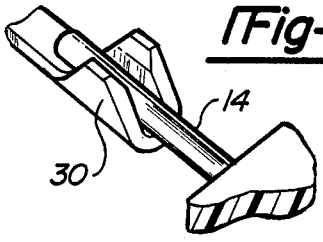

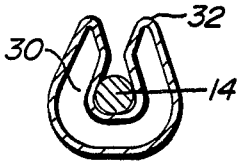
Fig-10b
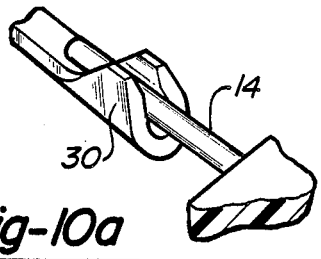
Fig-10a
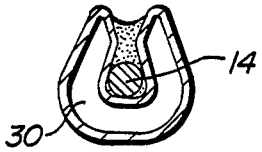
Fig-11b
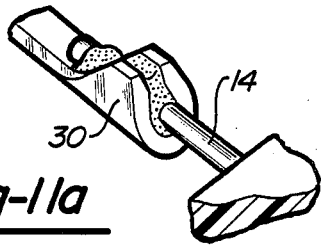
Fig-11a
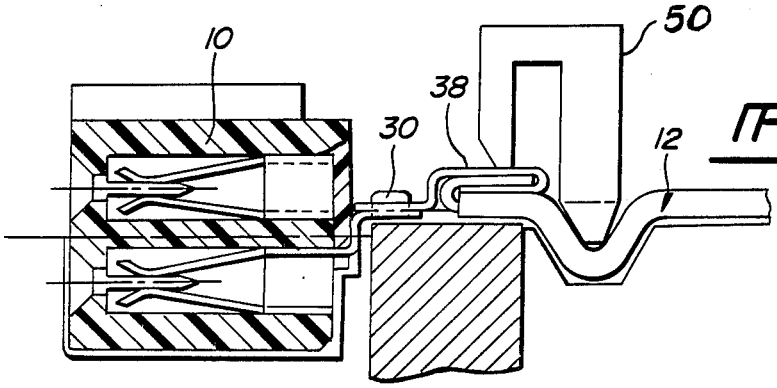
Fig-12
Fig-13
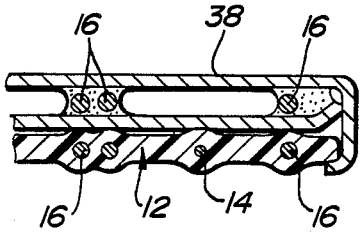

METHOD FOR CONNECTING WIRES TO AN ELECTRICAL CONNECTOR

BACKGROUND OF THE INVENTION

1. Field of the Invention.

The field of the invention relates to a method for connecting wires, particularly those within high density, flat transmission cables, to multipole connectors, and a crimp type micro-multipole connector for facilitating said method.

2. Brief Description of the Prior Art.

Electrical connections in many applications are made through such commonly known methods such as soldering, spot welding and lapping. In the field of micro-connectors, however, crimp type connections and insulator displacement connections (IDC) are more popular for connecting conductors to electrical connectors. The former method includes the clamping of a crimp barrel formed on the tail portion of a contact member about a conductor. The latter involves the pressing of an insulated wire into an IDC contact member having a U-shaped slot. Crimp connections are mainly used for connecting a single wire to a single crimp type contact member. IDC connections are generally employed in mass type connecting procedures wherein a plurality of conductors in a flat cable or ribbon cable are connected to IDC connectors having appropriately designed contacts therein.

The tendency towards miniaturization of electrical components has made traditional connecting methods less reliable. A high density signal transmission cable may have a plurality of signal conductors (e.g. 24), each having a diameter of about 0.20 mm distributed along 1.27 mm center lines. Grounding wires of about 0.254 mm diameter are provided on both sides of the signal wires and spaced about 0.46 mm therefrom. There is accordingly a space of about 0.35 mm between adjacent grounding wires. In order to connect a plurality of signal wires of such a high density flat cable to the related circuits, various types of 1.27 mm pitch multipole micro-connectors are employed. A plurality of wires in the flat cable may, for example, be simultaneously pressed into IDC contact members in an IDC type connector. If crimp connections are instead employed, a crimp barrel of a contact member is crimped to a conductor of an insulated wire and, thereafter, a plurality of contact members so crimped are successively inserted into the cavities of an insulator or housing. The method using IDC connectors has been preferred because of its simplicity.

The increasing miniaturization of flat cable has limited the ability to successfully employ IDC connectors. Due to the small distances between signal and/or ground wires, the U-shaped slots within IDC contact members must be extremely small to accommodate them. The mechanical strength of these contact portions is greatly reduced making it virtually impossible to use the IDC connecting process for flat cables having wire separation of less than 0.5 mm. In addition, resistance to vibration and tension is impaired as compared to crimp type connections. The resulting reduction in reliability is a fatal defect for this type of application. A connection failure in just one portion of the connector results in the loss of reliability in the connector generally.

While the crimp connection process as described above is technically feasible for miniaturized, high density, flat cables, the process of crimping the wires one by one and then securing the crimped contacts into housings is both difficult and inefficient.

Batch processes involving such crimp connections would also be impractical. Such processes would include utilizing a preassembly housing having a plurality of contact members therein, each contact member having a crimp section. The conductors of the flat cable would be inserted within the crimp sections and the crimp sections compressed simultaneously. It would be very difficult to assure reliable electrical connection at this high rate, however. In addition, the spacing of the comb-shaped teeth of a punch or crimper used for such a micro-connector would be so small that the strength of the crimper would be substantially reduced. Delicate controls would be required for installing the crimper and corresponding anvil and maintaining them during the crimping process.

Current technology does not permit the use of lapping techniques for high density flat cables. Soldering is also unacceptable as it would cause a short circuit between adjacent conductors due to fluctuation of the solder supply.

SUMMARY OF THE INVENTION

It is accordingly an object of the invention to provide a method which allows the connection of a plurality of conductors to a connector in an efficient and reliable manner.

The method provided by the invention employs both crimp connection technology and a soldering technique. A contact member is provided having a crimping section. The crimping section is plated with solder. Once a conductor has been inserted within the crimping section, the crimping section is pressed into contact with the conductor. Heat is then applied to the crimping section to fuse the solder. Reliable solder connections between the crimping section and conductor are made as the solder adheres to these mutually contacting members. Once the solder is cooled, the connection will be very resistant to shocks and vibration.

In accordance with a second embodiment of the invention having particular utility in connecting flat cables having ground and signal wires, a bus bar is employed together with contacts having crimping sections. Both the bus bar and crimping sections are solder-plated. The grounding wires are secured to the bus bar which, in turn, is secured to the cable. The signal wires are crimped to the contacts, the contacts being mounted to an insulator. Thereafter, in order to solder the bus bar to the grounding wires, and the crimping sections to the signal wires in a batch process, the entire solder-plated assembly is heated to fuse the solder.

A crimp type, micro-multipole connector is also provided by the invention which facilitates the practice of the method according to the invention.

BRIEF DESCRIPTION OF THE DRAWINGS

FIG. 1 is a perspective view showing a connector assembly and a flat cable assembly in accordance with the invention;

FIG. 2 is a perspective view of a flat cable having ground and signal wires extending therefrom;

FIG. 3 is a diagram showing the arrangement of contacts of a crimp type multipole connector;

FIG. 4 is a perspective view of a bus bar employed in accordance with the invention;

FIG. 5 is a perspective view of the flat cable shown in FIG. 2 having the ground wires bent rearwardly;

FIG. 6 is a side elevation view of the bus bar being mounted to the ground wires of the flat cable;

FIG. 7 is a side elevation view thereof showing the bus bar engaging a surface of the flat cable;

FIG. 8 is a perspective view showing a portion of the edge of a flat cable to which a bus bar is mounted;

FIG. 9A is an enlarged perspective view illustrating a conductor within the crimp section of a contact;

FIG. 9B is a sectional view thereof;

FIG. 10A is an enlarged perspective view similar to FIG. 9A showing the crimp section compressed into contact with the conductor;

FIG. 10B is a sectional view thereof;

FIG. 11A is a perspective view similar to FIG. 10A after heat has been applied thereto;

FIG. 11B is a sectional view thereof;

FIG. 12 is a sectional side elevation view showing a heating device for heating the connection between a crimp type connector and a flat cable; and FIG. 13 is a sectional view illustrating a bus bar soldered to ground wires of a flat cable.

DETAILED DESCRIPTION OF THE INVENTION

Referring to the figures, the invention shall be described in conjunction with the connection of a high density flat cable with a crimp type multipole connector 10. The flat cable 12 includes a plurality of parallel signal wires 14 and ground wires 16, all of which may be silver-plated copper wires. The wires are supported by a flexible insulator film made from TEFLON or the like. Twenty-four signal wires 14 and forty-eight grounding wires 16 are provided within the high density cable 12. The signal wires each have a diameter of about 0.20 mm while the grounding wires have about a 0.254 mm diameter. A spacing of about 0.46 mm is provided between signal and ground wires. The spacing between signal wires is about 1.27 mm. The spacing between adjacent grounding wires is accordingly about 0.35 mm.

The multipole connector 10 includes an insulator housing 22 which defines upper and lower rows of thirteen cavities 24. Female contacts 26 are positioned within each cavity. Projections 28 extending laterally from the contacts maintain them within the respective cavities. Each contact includes a crimp barrel 30 projecting from the rear side of the housing 22. The spacing between crimp barrels is the same as that between signal wires, i.e. about 1.27 mm. Each crimp barrel 30 includes a solder plating 32 as shown in FIG. 9B. The plating is preferably twenty to thirty microns in thickness, which is exceptionally large compared with the tin plating of several microns often used on contacts, and is applied prior to mounting the contacts to the housing. A solder composition of seventy-five percent tin and twenty-five percent lead is suitable for the purposes of the invention, although other percentages of these metals could also be successfully employed.

Each contact 26 includes a pair of opposing spring members 34 positioned within one of the cavities for receiving a pin 36 of a male connector. A representative arrangement of contacts is shown in FIG. 3. The encircled numerals indicate the post numbers of the contacts to be grounded.

A bus bar 38 for soldering the grounding wires 16 of the flat cable 12 and connecting them to ground is shown in FIG. 4. The bus bar is generally c-shaped, and may be formed by pressing and punching. It is also entirely plated with a thick solder plating between twenty and thirty microns. A plurality of slots 40 are formed in one end of the bus bar while integral ground pins 42 extend from the other end thereof. A total of six ground pins are provided to correspond with the contact members to be grounded as shown in FIG. 3. The slots 40 are of appropriate size to receive the grounding wires 16 of the cable. A pair of laterally extending tabs 44 are provided for securing the bus bar to the cable.

The bus bar, which has substantially the same width as that of the cable, is initially secured to the cable by inserting the ends of selected cable wires into the slots 40. The wire ends are exposed by peeling off the cable film near one end of the cable as shown in FIG. 2. The exposed ends of the grounding wires 16 and of six signal wires 14 corresponding to the positions of the grounding pins 42 are bent back to form an acute angle with the cable surface. FIG. 5 is illustrative of a cable end portion having grounding wires bent back in this position. The bent wires are inserted into the slots 40 of the bus bar as shown in FIG. 6. The bus bar is then moved into contact with the cable surface (FIG. 7), the lateral tabs 44 thereof being bent to secure the bus bar to the cable. FIG. 8 provides a perspective view of the cable/bus bar assembly which is ready for mounting to the multipole connector 10. Twenty signal wires 14 and six grounding conductors 42 are parallely spaced at a pitch of 1.27 mm, the same as that of the crimp barrels 30 extending from the multipole connector 10.

Referring now to FIGS. 9–11, the signal wires 14 and grounding conductors 42 are positioned within the corresponding crimp barrels 30. As discussed above, the method according to the invention includes applying a thick solder plating to the crimp barrels prior to mounting the contacts 26 within the connector. The crimping process (FIGS. 10A, 10B) is performed upon all barrels simultaneously in a well-known process. The crimper (not shown) employed in this procedure includes twenty-six punches arranged at a pitch of 1.27 mm and an anvil. The plated interior surfaces of the crimp barrels 30 and the wires 14 and pins 42 therein are brought into physical contact with each other as shown in FIG. 10B through the crimping process.

The crimping of the crimp barrels in accordance with the invention is not necessarily intended to achieve the high reliability of electrical connections for which crimping is conventionally employed. It is sufficient if the crimp barrels and conductors are in sufficiently close proximity, and preferably in contact with each other, so that melting solder will tend to move between the respective crimp barrels and conductors under the forces of capillary action as explained hereinafter.

FIGS. 11–13 illustrate the final step through which highly reliable electrical connections are made in a batch process. The bus bar 38, crimp barrels 30, and conductors 14,42 within the crimp barrels are exposed to a heat source such as a high frequency induction heating device 50. This fuses the solder plating applied to the crimp barrels and bus bar. The grounding wires 16 and bus bar 38, and signal wires 14 and crimp barrels, are respectively soldered together as the assembly is allowed to cool. As shown in FIG. !2, the bus bar is preferably pressed during the heating operation.

As discussed above, the fused solder expands over the metal surfaces to be connected due to capillarity. In order to insure proper flow of the solder, it must be heated to an appropriate temperature and all metal surfaces must be clean. It is also advantageous if the insulating material for the flat cable be heat resistant. The use of TEFLON material for this purpose has been found to be satisfactory.

While a preferred method for practicing the invention has been set forth above, several modifications can be considered for various applications. The bus bar and conductors of the flat cable can be heated to complete soldering prior to placing the signal wires within the crimp barrels and employing the crimper therewith. In addition, should the flat cable include no grounding wires, the bus bar may be entirely omitted.

It will be appreciated that the invention allows the connection of a flat cable or the like having small, closely spaced conductors to be reliably connected to an electrical connector in a batch process. The danger of wire breakage due to shock or vibration is reduced as the edges of the contacting members are smoothed or rounded by the flow of the solder. The solder also helps prevent oxidation of the connecting portions.

What is claimed is:

1. A method for connecting a plurality of conductors extending from a flat cable to a crimp tye micro-connector including a plurality of contacts having crimp barrels, comprising:

providing a solder-plated bus bar, mounting a first group of selected conductors of said flat cable to said bus bar, securing said bus bar to said flat cable, heating said bus bar to fuse said solder plating thereon, allowing said bus bar to cool, whereby said first group of conductors of secured to said bus bar by means of said solder, providing a solder plating upon said crimp barrels, positioning portions of a second group of selected conductors within said crimp barrels, crimping said crimp barrels into contact with said second group of conductors therein, heating said crimp barrels, thereby fusing said solder plating, and allowing said solder to cool, whereby said second group of conductors are secured to said respective crimp barrels by means of said solder.

2. A method as defined in claim 1 wherein said first group of selected conductors are grounding conductors.

3. A method as defined in claim 1 wherein said crimp barrels and bus bar are heated simultaneously.

4. A method as defined in claim 1 wherein said crimp barrels are of sufficiently small dimensions and said solder plating is sufficiently thick that upon fusing said solder plating, said solder within said crimp barrels flows between said respective crimp barrels and conductors by capillary action.

5. A method as defined in claim 4 wherein said solder plating is about twenty to thirty microns in thickness.

6. A method as defined in claim 1 including the steps of bending said selected conductors to define an acute angle with respect to said flat cable, inserting said selected conductors within said bus bar, and clamping said bus bar to said flat cable.

7. A method as defined in claim 1 wherein said selected conductors include grounding conductors and signal conductors.

8. A method for connecting a plurality of conductors, which are positioned within a flat cable and running substantially parallel to each other, to a crimp type connector, comprising:

stripping an end portion of said flat cable, thereby exposing said end portions of said conductors, providing a solder-plated bus bar, mounting end portions of a first group of said conductors to said bus bar, securing said bus bar to said flat cable, heating said bus bar, thereby fusing said solder plating thereon, allowing said bus bar to cool, whereby said end portions of said selected conductors are secured to said bus bar by means of said solder, providing a plurality of contacts, each of said contacts including a crimp barrel, applying a solder plating to each of said crimp barrels, positioning end portions of a second group of said conductors within said crimp barrels, crimping said crimp barrels into contact with said end portions of said second group of conductors therein, heating said crimp barrels; thereby fusing solder plating, and allowing said fused solder to cool, whereby said respective end portions of said second group of conductors are secured to said respective crimp barrels by means of said solder.

9. A method as defined in claim 8 wherein said solder plating applied to said crimp barrels is between about twenty to thirty microns in thickness.

10. A method as defined in claim 8 wherein said solder plating upon all of said crimp barrels is fused simultaneously.

11. A method as defined in claim 8 wherein said crimp barrels are of sufficiently small dimensions and said solder plating is sufficiently thick such that upon fusing said solder plating, said solder within said crimp barrels flows between said respective crimp barrels and conductors by capillary action.

* * * * *